United States Patent [19]

Bielagus

[11] Patent Number: 5,037,537

[45] Date of Patent: Aug. 6, 1991

[54] WOOD PARTICLE SCREEN

[75] Inventor: Joseph B. Bielagus, Tualatin, Oreg.

[73] Assignee: Beloit Corporation, Beloit, Wis.

[21] Appl. No.: 617,475

[22] Filed: Nov. 20, 1990

Related U.S. Application Data

[63] Continuation of Ser. No. 7,425,910, Oct. 24, 1989, abandoned.

[51] Int. Cl.[5] ..... B07C 1/54

[52] U.S. Cl. ..... 209/382; 198/630; 209/358; 209/403

[58] Field of Search ..... 209/381, 382, 399, 403, 209/404, 323, 324, 358, 369, 379, 347, 349, 330, 383, 336, 338, 343, 340, 334, 345; 198/630

[56] References Cited

U.S. PATENT DOCUMENTS

| | | | |
|---|---|---|---|
| 749,578 | 1/1904 | Porter | 209/347 X |
| 1,657,414 | 1/1928 | Silver | 209/308 |
| 1,693,940 | 12/1928 | Robins | 209/404 X |
| 1,958,322 | 5/1934 | Symington | 209/308 |
| 3,014,587 | 12/1961 | Philippovic . | |
| 3,106,249 | 10/1965 | Johnston | 209/308 |
| 3,217,881 | 11/1965 | Wehner | 209/382 |
| 3,756,407 | 9/1973 | Christensen | 209/672 |
| 4,037,723 | 7/1977 | Wahl et al. | 209/672 |
| 4,377,474 | 3/1983 | Lindberg . | |
| 4,504,386 | 3/1985 | Dyrén et al. . | |
| 4,741,444 | 5/1988 | Bielagus | 204/672 |
| 4,839,036 | 6/1989 | Slesarenko | 209/382 X |

FOREIGN PATENT DOCUMENTS

| | | | |
|---|---|---|---|
| 383054 | 5/1987 | Austria . | |
| 0197191 | 10/1986 | European Pat. Off. . | |
| 1273310 | 7/1968 | Fed. Rep. of Germany . | |
| 650242 | 1/1929 | France . | |
| 2217052 | 9/1974 | France . | |
| 1102635 | 7/1984 | U.S.S.R. . | |
| 897316 | 10/1986 | U.S.S.R. . | |
| 3236 | 3/1886 | United Kingdom | 209/308 |

OTHER PUBLICATIONS

Burnaby Machine & Mill Equip.; "Chip Screens for Wood Chips, Sawdust, Scalping", pp. 1-14.

Rauma-Repola: "Rauma-Repola Chip Screens", pp. 1-6.

Liwell; "Flip-Flow Screening Machines Type LI-WELL", pp. 1-4.

*Primary Examiner*—Donald T. Hajec

*Attorney, Agent, or Firm*—Dirk J. Veneman; Raymond W. Campbell

[57] ABSTRACT

A wood particle screen particularly useful for separating fines from wood chips in which a bed of flexible foraminous material having holes therein sized to permit fines to pass therethrough is flexibly mounted for receiving a flow of wood chips and fines thereon. Beater rolls are disposed beneath the screening bed, each including a plurality of spaced beater bars so positioned as to contact the bottom of the screening bed as the bars rotate through the uppermost position of the rolls.

13 Claims, 3 Drawing Sheets

WOOD PARTICLE SCREEN

This is a continuation of copending application Ser. No. 07/425,910 filed on Oct. 24, 1989 now abandoned.

BACKGROUND OF THE INVENTION i. Technical Field

The apparatus of the present invention relates generally to the field of sorting operations, and relates more particularly to an apparatus for separating a continuous stream of wood chips into separate fractions based on chip size. Specifically, the invention pertains to a wood particle screen particularly useful for separating small particles, or fines, from the larger, acceptable wood chips.

ii. Prior Art

In the papermaking process, wood chips are cut from pulp wood logs, and are cooked in digesters to remove lignin and release the cellulose fibers for paper production. For optimum digester operation and pulp production, it is desirable to control the proportions of oversize and undersize wood chip fractions placed into the digesters. Therefore, various types of screening devices have been used in the past to separate oversize wood chips, which may be undercooked in a digester, from chips within the acceptable size range; and also for removing undersized chips, which may be overcooked in the digester, from the acceptable fraction. The oversized can be sliced and returned, while the undersized having useful fiber can be returned in acceptable proportions through metered flow.

The smallest size particles in a chip stream are commonly referred to as fines, and, while the precise definition of fines may vary from pulp mill to pulp mill, fines can generally be described as the dust-like material having little useful fiber. In most operations, fines are undesirable and complete removal is desirable. However, the slightly larger material, frequently called pins, has useful fiber and can be tolerated in acceptable proportions. Frequently, the distinction between fines and pins is determined by screening through a 3 millimeter round hole, that material passing through the hole being fines.

A widely-accepted type of screen used for separating wood chips into fractions based on chip thickness is a disk screen. In a disk screen, a plurality of parallel shafts have spaced disks thereon, and the disks from adjacent shafts interleave with one another to define interdisk facial openings (I.F.O.s). Material smaller than the screen I.F.O. passes through the screen, while the larger material carries over the screen. The contour of the peripheries of the disks, the disk size and shaft rotational speed can be selected to agitate the chip stream as aggressively as desired. Chip agitation will tend to break-up clumps, reorient chips and sift the smaller particles from larger chips.

Disk screens have been widely used for various types of screening, such as removing oversize or undersize chips, utilizing I.F.O.'s of various dimensions. In some screening operations, disk screens are arranged substantially flat, while in other operations, commonly referred to as V-screens, two disk screen beds are angled upwardly. Typically, on flat disk screens the general direction of chip flow is perpendicular to the rotatable shafts, and in V-screens the chip flow is generally parallel to the shafts.

While disk screens can be assembled with I.F.O.'s and chip agitation which result in very high fine removal efficiency, a substantial portion of the slightly larger fiber material, including pins, will also pass through the disk screen. High pin loss in such systems is undesirable, and separate fines/pins classification may be required following a disk screen used for fines removal.

Shaker screens are also used for fines removal, and generally consist of a rigid plate, frequently disposed at an angle, through which holes are provided. The plate is movably mounted on springs or pivotable suspensions. A drive is provided to move or shake the plate, often in an orbital path or in linear oscillation, to slide the chips along the plate surface, thereby enabling fines to pass through the openings. Holes in the shaker screen must be quite small, on the order of 3 millimeters diameter, to reduce the loss of acceptable fibers such as those contained in pins. In inclement weather, snow, ice, and the like can fill the openings, as can dirt, mud, and other grime frequently found in pulp mill operations. Small wood chips also can become wedged in the openings, thereby preventing fines from passing therethrough. When a substantial portion of the holes in a shaker screen become blinded by chips, dirt, snow, or the like, the fines removal efficiency of the screen decreases dramatically.

The generally planar movement of the shaker screen plate, either orbital or linearly reciprocating, does not aggressively agitate the wood chips, and fines clinging to the chips frequently will not be dislodged therefrom. Therefore, while pin chip loss in a shaker screen may be less than for disk screens, the fines removal efficiency, even under optimal operating conditions is not as high for shaker screens as for disk screens, and the efficiency decreases still further when blinding occurs. A further disadvantage of shaker screens is that the reciprocating or orbital movement of the heavy shaker plate creates excessive vibration, requiring compensation in the structure of the screen unit.

Modified shaker screens having screen beds of flexible material, such as polyurethane, have been used with intermittent supports beneath the deck being movable to cause intermediate portions of the deck between adjacent supports to flex or buckle. The shape of the deck between supports changes from a substantially flat to depressed or concave. While the flexible screening beds, like the rigid shaker screens, substantially reduce the pin chip loss, blinding remains a problem, and separation of fines which are adhered to acceptable chips is not as efficient as in disk screens. Substantial nonactive screening areas exist along the regions of the support bars. While perhaps exceeding conventional shaker screens, the overall fines removal efficiency generally is not as high for this type of screen as for disk screens, and falls even lower when blinding occurs.

Other types of winnowing apparatus using air flow to separate fractions have been used for screening wood chips, but tend to separate more on mass and aerodynamic properties than do other types of screens. Efficiency, therefore, is less. Rotating separators applying centrifugal force to the chips have also been used, but with mixed results.

SUMMARY OF THE INVENTION

It is, therefore, one of the primary objects of the present invention to provide a wood particle screen useful for separating the smallest material from larger material, useful in wood chip screening for removing fines from a chip stream; and which removes only the smallest particles, or fines, while, in wood chip screening, leaving the pins or slightly larger material having useful fiber.

Another object of the present invention is to provide a wood particle screen which is highly efficient in fines removal, while minimizing pin chip loss, and which experiences minimal blinding, or clogging, even under undesirable operating conditions.

Still another object of the present invention is to provide a wood particle screen which can be economically manufactured and operated, and which substantially reduces vibration as compared to convention shaker type wood chip particle screens.

A further object of the present invention is to provide a wood particle screen which has a high percentage of open-screen area, thereby minimizing the percentage of nonactive area in the screening zone, as compared with conventional screens; and which aggressively agitates and reorients the material as it passes through the screening zone to separate fines from acceptable chips, even when the fines are adhered to acceptable chips, thereby allowing the fines to pass through the screen and minimizing fine carry-over by acceptable chips.

These and other objects are achieved in the present invention by providing a wood particle screen having a screening bed of flexible, foraminous material having holes sized to permit only those particles smaller than an acceptable size range to pass therethrough. The bed can be made of a fine, mesh-like material having a substantial open area, with minimal non-open regions therebetween. Chips are provided to one end of the screen, and those chip particles not passing through the screen are removed from an opposite end of the screen. A plurality of beater rolls are disposed beneath the screening bed, each including a plurality of spaced beater bars so positioned as to contact the bottom of the screening bed at the upper most position. Contact between the beating bars and the foraminous, flexible material causes the larger wood chips in contact with the top surface to be accelerated vertically away from the surface; while the smaller, lighter materials can quickly pass through the screen.

In operation, the larger material appears to dance down the surface of the screening bed, contacting the surface only briefly before being accelerated away from the bed. The larger particles, in effect, remain substantially suspended above the screening bed. The opportunities for chips or other material on the screening surface to plug, or blind, the screening holes are minimized. Further, as a result of the abrupt, rapid acceleration caused by the beater bar contact with the screen bed, material beginning to lodge in the screening openings is quickly dislodged therefrom, before becoming firmly wedged in the hole by the chip flow. Fines adhering to acceptable chips are dislodged therefrom by the aggressive agitation in the screening zone.

Rotation of the beater rolls and the sequential contact between bars of progressively downstream beater rolls can be coordinated to create a wave-like effect along the screening surface, substantially suspending the larger material above the screen, while permitting the smaller, fine material to gently sift through the screen without substantial blinding of the screen openings. In this manner, the wood particle screen of the present invention combines the fines separation efficiency of a disk screen with the low acceptable fiber loss found in shaker screens.

Further objects and advantages of the present invention will become apparent from the detailed description and the accompanying drawings.

DETAILED DESCRIPTION OF THE PREFERRED EMBODIMENT

Figure 1:
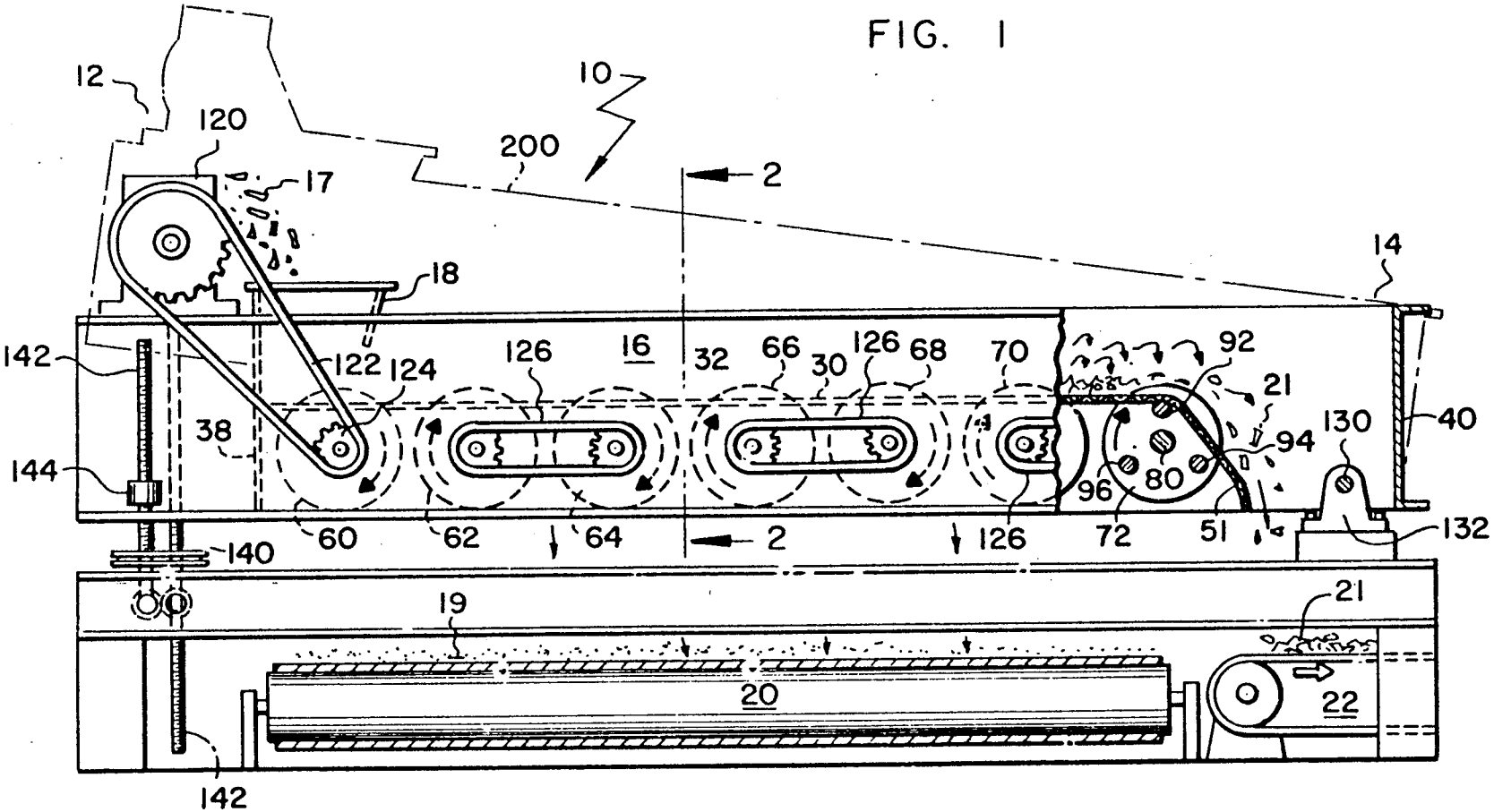
FIG. 1 is a vertical view of a wood particle screen embodying the present invention, partially broken away and in partial cross-section.

Referring now more specifically to the drawings, and to FIG. 1 in particular, numeral 10 designates, generally, a wood particle screen embodying the present invention. Wood particle screen 10 has an inlet end 12 and an outlet end 14, with an intermediate screening zone 16 disposed therebetween. A stream of wood chips 17 is provided at the inlet end 12 through an inlet chute 18 to the screening zone 16, and passes over the screening zone 16 to the outlet end 14. Small particles, or fines 19, are separated from the larger wood chip material, including pins, in the screening zone 16, and pass through the screening zone 16 to a fines removal system 20. The larger chips 21, including most of the pins only slightly larger than fines, pass off the screen at the outlet end 14 to a screened chip removal system 22. In this way, the smallest material, or fines, are removed from the larger material, including pins, having usable cellulose fiber.

It will be recognized by those familiar with the art that numerous types of fines removal systems 20 and screened chip removal systems 22 may be utilized, including conveyors, augers, slides and the like. In FIG. 1, conveyors are illustrated as suitable removal systems, but should not be considered as the only removal systems appropriate for use with the present invention.

So also, the inlet end 12, in addition to the inlet chute 18, may also include flow distributing apparatus, such as distribution conveyors and the like, as well as conveyors, slides, or the like for bringing a relatively continuous stream of wood chips to the inlet end of the wood particle screen. Such systems are well-known to those versed in the art, do not constitute a part of the present invention, and will not be described in further detail herein.

Screening zone 16 includes a screening bed 30 at which the particle separation occurs, and an agitating system 32 disposed beneath the screening bed 30. The agitating system 32 imparts force to the screening bed, to accelerate material away from the screening bed. The screening bed 30 and agitating system 32 are mounted within a frame having sides 34 and 36 and ends 38 and 40 of channel iron, angle iron or the like.

Screening bed 30 consists of a foraminous, flexible sheet 50 of material having holes or openings of suitable size to pass therethrough the fines or other material which is to be separated from the chip stream. Non-open regions between the holes are minimal, so that a large percentage of the bed is open area, thereby providing extensive, efficient screening in a minimal area. The foraminous, flexible material can be screen-like, or plate-like, and may be made advantageously of polyurethane covered high carbon wire mesh, or other long-wearing, abrasion resistant material to which wood chips and the like will not readily adhere. By using a screening bed made from material to which the screened material will not readily adhere, the potential for blinding, or plugging, of the holes is further minimized.

The flexible sheet 50 extends from the inlet end 12 over the entire screening zone 16 to the outlet end 14. Normally, the sheet 50 will be connected to a back wall of the inlet chute 18, so that all material passing through the inlet chute 18 is deposited on the flexible sheet 50. At the outlet end 14, the sheet 50 may advantageously include an unaffixed downwardly depending tail 51 for guiding material passing off and out of the screening zone 16 onto the chip removal system 22.

Figure 2:
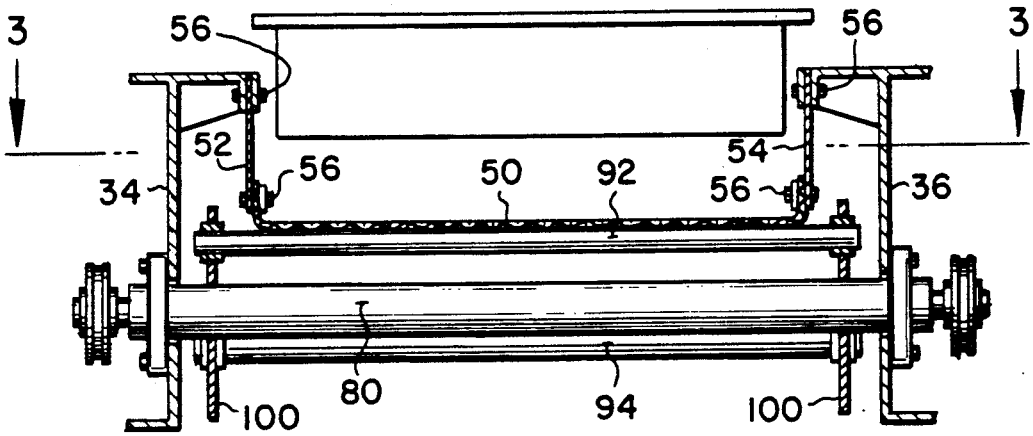
FIG. 2 is a vertical, cross-sectional view of the wood particle screen shown in FIG. 1, taken along line II—II of FIG. 1.
Figure 3:
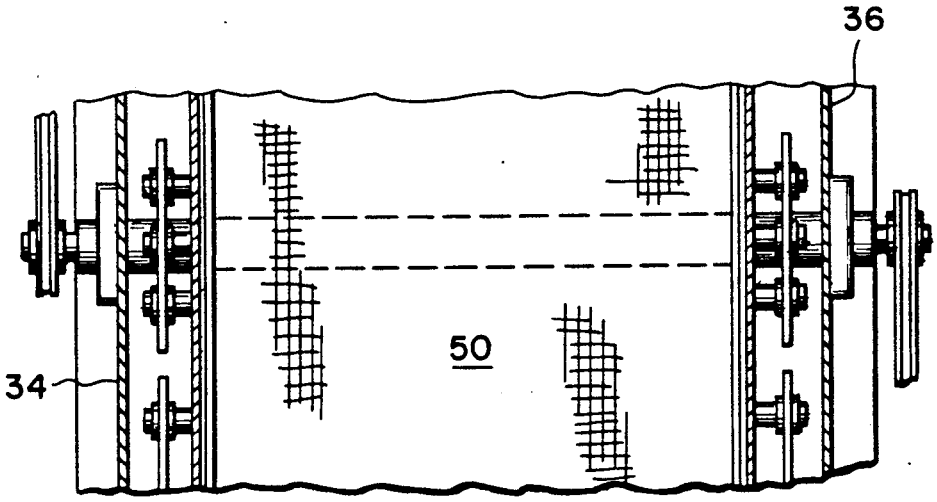
FIG. 3 is a horizontal, cross-sectional view of the wood particle screen, taken along line III—III of FIG. 2.
Figure 4:
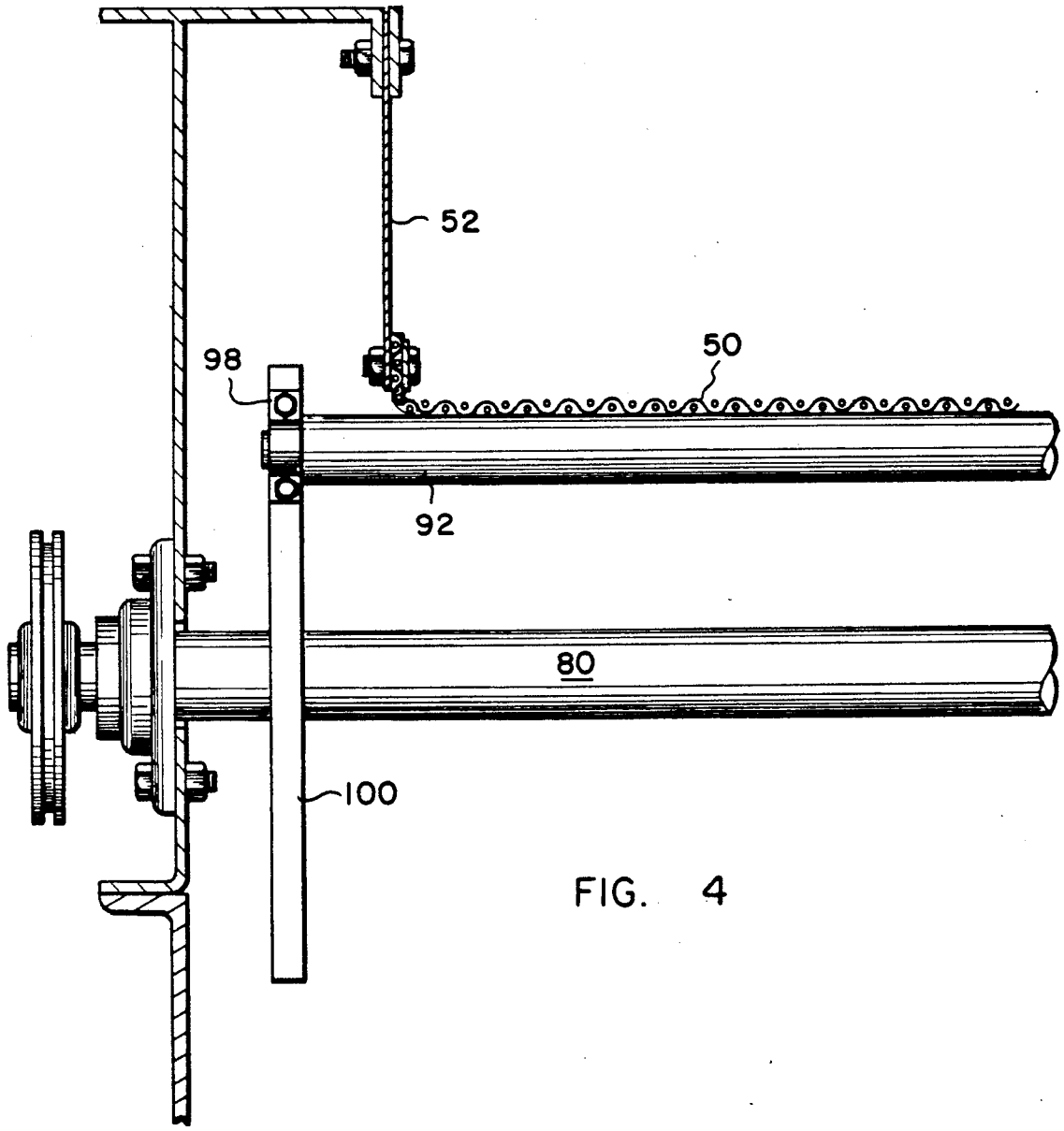
FIG. 4 is an enlarged, cross-sectional view of a beater roll assembly from a wood particle screen embodying the present invention.

The foraminous, flexible sheet 50 is suspended from frame sides 34 and 36 by bed supports 52 and 54, held by suitable clamping means 56. The flexible sheet 50 is a substantially continuous sheet, unsupported underneath, and supported only at its edges by the bed supports 52 and 54. In a preferred embodiment, the bed supports are flexible and move with the bed. A particularly suitable bed support has been found to be a polyurethane reinforced material similar to canvas; however, other flexible sheets also can be used. As illustrated, particularly in FIG. 2, the bed supports provide side-walls for containing the chips, as well as dust, on the screening bed, as the chips progress from the inlet end to the outlet end of the screen. In some applications, taller or shorter bed supports may be desirable, and means for applying tension to the foraminous, flexible sheet of material 50 also may be included. Covers may be provided over the screening zone 16, sufficiently elevated thereabove by the frame to contain dust without interfering with the chip action in the screening zone.

Agitating system 32 consists of a plurality of rotatable beater rolls disposed beneath the screening bed for periodic engagement therewith, when the beater rolls are rotated. In the drawings, individual beater rolls 60, 62, 64, 66, 68, 70, and 72 are shown; however, it should be understood that more or fewer beater rolls may be used, depending on the length of the screening bed. Each beater roll includes an inner drive shaft 80 journaled at opposite ends in bearings 82 mounted in frame members 34 and 36. Each beater roll further includes beater bars 92, 94, and 96 journaled in bearings 98 mounted in beater bar support plates 100 mounted at opposite ends of the inner drive shaft 80. The beater bar support plates 100 are drivingly connected to the inner drive shaft 80, so that rotation of the inner drive shaft 80 rotates the beater bar support plates as well. Welding, pins, keys, interference fits, or the like can be used for affixing the support plates 100 to the inner drive shafts 80.

The size of the support plates 100, the number of and circumferential spacing of the individual beater bars in the support plate, and the longitudinal spacing of the inner drive shafts 80 along the screening bed are selected to impart the desired action to the screen bed, and to minimize dead or inactive spots along the screening bed between the beater rolls. The vertical spacing between the foraminous, flexible material 50 and the beater rolls is selected such that the individual beater bars contact and deflect the foraminous, flexible material 50 upwardly as the beater bars pass through their uppermost position. As the beater rolls rotate through the positions between contact by successive beater bars, a brief period of time may exist wherein neither the last contacting nor next to contact beater bar is in contact with the screen. This will allow the screen to momentarily settle down to its relaxed, undeflected position between beater bar contacts.

As each beater bar comes in contact with the flexible, foraminous material 50, and deflects the material upwardly, the beater bar rotates in its bearings 98, thereby minimizing abrasive, frictional wear between the beater bars and the sheet 50. To further the wear resistance of the beater bars and the sheet 50, the bars may be made of or covered with polyurethane or other long wearing material.

A motor, or other suitable drive mechanism 120, is provided for rotating the beater rolls; and chains, belts or the like 122 interconnect the motor 120 and sprockets or pulleys 124 on the beater rolls. In the drawings, drive chains 126 between adjacent roll pairs are shown, and would include a chain 126 connecting rolls 60 and 62 on the side of the rolls opposite that shown in FIG. 1, a second chain 126 connecting rolls 62 and 64, as shown in FIG. 1, and so forth throughout the screening bed. It should be recognized that other types of drive mechanism may be utilized, including a single-drive chain interconnecting all rolls, individual drive mechanisms for each roll, including variably controllable motors and the like, depending on the degree of control and refinement required in the rotation of each beater bar roll.

Control of the angular orientation of the screening bed is also desirable, to control the throughput rate of the screen. For this purpose, the frame in which the screening bed 30 and beater system 32 are mounted is pivotally connected at the outlet end by a shaft or shafts 130 mounted in supports 132. The inlet end 12 is supported by a vertically adjustable screw support mechanism designated generally by the number 140, which, as is commonly known, may include several threaded rods 142, threadedly engaging complementarily threaded receivers 144 fixed to the frame of the screen. Rotation of the threaded rods 142, such as by a driving connection to a motor not shown, causes the receivers 144 to move vertically on the threaded rods, thus changing the vertical position of the inlet end 12. When the inlet is highly elevated and the screening bed angled downward, retention time on the bed is less than when the inlet is low and the bed is substantially flat. Dashed line 200 in FIG. 1 shows the outline of the particle screen when the inlet end 12 is in a highly elevated position.

In the use and operation of a wood particle screen embodying the present invention, wood chips are provided to the inlet end 12 at the inlet chute 18, and preferable are evenly dispersed therein. As the chips including the fines, pins, and acceptable chips pass through the inlet chute 18, the entire flow is deposited on the flexible sheet 50. Beater roll 60 is rotated so that the individual beater bars 92, 94, and 96 successively and repeatedly come in contact with the flexible sheet 50, thereby imparting a vertical force component to the sheet 50, and to any chips or material in contact therewith. The contact by the individual beater bars with the sheet 50 causes an upward deflection of a portion of the sheet 50 above the beater roll 60. This deflection progresses within the region from the inlet end of the region toward the outlet end of that region. This generally, flowing type deflection also imparts forward and upward force components to the chips, and the chips and larger material generally dance or vibrate along the top of the sheet 50 toward the next beater roll 62. The very smallest particles, including fines, are not sufficiently contacted by the sheet 50 to carry along the sheet 50 at its upper surface all the way to the outlet end 14. Instead, the small materials, including fines, eventually pass through the openings in the foraminous sheet 50, fall through the beater rolls or the spaces therebetween and are deposited in the fines removal system 20. The larger material moves along the screening zone 16 being successively contacted and accelerated by the beater rolls 60, 62, 64, 66, 68, 70, and 72; eventually passing off of the sheet 50 at the downwardly depending tail 51.

Normally, the forward component imparted to the larger material by the various beater rolls is sufficient to cause the material to progressively move across the screening zone 16 even when the screening zone 16 is substantially horizontal in orientation. However, in some instances, particularly when the fines component is quite small, it is desirable to minimize the retention time in the screening zone 16 and to allow the material to move rapidly from the inlet end 12 to the outlet end 14. By operating the adjustable screen support mechanism 140, the inlet end of the screen can be elevated, with the outlet end pivoting at its rod connections 130.

The aggressive action imparted to the material on the screening bed causes fines to be dislodged from larger pieces to which it may be attached. The rather violent beating of the flexible sheet dislodges any material which otherwise may blind holes in the sheet. However, wear of the sheet or beater bars is significantly lessened by the rotatable mounting of the beater bars in the support plate. As each bar comes in contact with the bottom of the flexible sheet 50, the beater bar rotates in its bearing support, thereby creating a rolling contact with the bottom of the sheet and minimizing wear.

While various preferred features of my invention for a particle screen have been shown and described in detail herein, it should be understood that various changes may be made without departing from the scope of the present invention.

I claim:

1. A screen for separating wood chips into first and second fractions based on size, said screen comprising:

a bed of foraminous flexible material having a chip receiving surface, said bed having an inlet end, an outlet end and side edges extending therebetween;

said material being fixed at said inlet end thereof and unaffixed at said outlet end thereof;

flexible bed support means for supporting said bed at said edges in a relaxed, undeflected position;

chip supply means for depositing on said chip receiving surface, near said inlet end of said foraminous flexible material, a volume of chips to be separated into first and second fractions;

agitating apparatus including a plurality of rotatable beater rolls disposed below said bed for inducing oscillating movement in said bed, causing chips thereon to be repeatedly accelerated away from said chip receiving surface and to return to said chip receiving surface, thereby freeing particles smaller than openings in said foraminous flexible material to pass through said material, said beater rolls having a discontinuous outer surface and being positioned relative to said bed to provide periods of contact and separation between said rolls and said bed during rotation of said rolls;

first fraction receiving mans at said outlet end for collecting from said foraminous flexible material particles too large to pass through said openings; and second fraction receiving means for collecting particles which pass through said openings of said foraminous flexible material.

2. A screen for separating wood chips into first and second fractions based on size as defined in claim 1, in which tensioning means is provided for placing said foraminous flexible material under substantial tension causing spring-like reflex to said agitating apparatus, while maintaining said edges yieldable therealong.

3. A screen for separating wood chips into first and second fractions based on size as defined in claim 2, in which drive means is provided for controlling rotation of said beater rolls, to induce progressive wave-like movement of said foraminous flexible material between an inlet end of said foraminous flexible material at which chips are deposited thereon, and an outlet end of said foraminous flexible material at which chips not passing through said foraminous flexible material pass off the surface thereof.

4. A screen for separating wood chips into first and second fractions based on size as defined in claim 3, in which said inlet end is elevated with respect to said outlet end, thereby defining a generally downwardly sloping path from said inlet end to said outlet end.

5. A screen for separating wood chips into first and second fractions based on size as defined in claim 1, in which drive means is provided for controlling rotation of said agitating means, to induce progressive wave-like movement of said foraminous flexible material between an inlet end of said foraminous flexible material at which chips are deposited thereon, and an outlet of said material at which chips not passing through said foraminous flexible material pass off the surface thereof.

6. A screen for separating wood chips into first and second fractions based on size as defined in claim 5, in which said inlet end is elevated with respect to said outlet end, thereby defining a generally downwardly sloping path from said inlet end to said outlet end.

7. A screen for separating wood chips into first and second fractions based on size as defined in claim 1, in which adjustment means are provided for controlling the angular orientation of said bed.

8. A screen for separating wood chips into first and second fractions based on size as defined in claim 1, in which each beater roll of said plurality of rotatable beater rolls includes first and second end plates disposed generally beneath and at the sides of said bed, and a plurality of beater rods extending between said end plates.

9. A screen for separating wood chips into first and second fractions based on size as defined in claim 8, in which said rods are mounted in bearings in said end plates.

10. A wood particle screen comprising:

a screening bed of substantially continuous, flexible foraminous material;

chip supply means disposed at a first, affixed end of said flexible foraminous material;

first chip fraction receiving means disposed at a second, unaffixed end of said flexible foraminous material opposite said first end;

second fraction receiving means disposed beneath said flexible foraminous material;

bed suspension means for yieldably supporting edges of said flexible foraminous material between said first end and said end opposite said first end in a relaxed, undeflected position; and agitating means disposed beneath said flexible foraminous material for vibrating said screening bed as a wood chip stream passes over said material, said agitating means including a series of beater bars, the rotation of which provides periods of contact and noncontact between said beater bars and said foraminous flexible material.

11. A wood particle screen as defined in claim 10, in which beater rolls of said agitating means each include first and second end plates disposed beneath said bed substantially beneath said suspension means, and a plurality of beater bars disposed between said first and second end plates.

12. A wood particle screen as defined in claim 11, in which said beater bars are mounted in bearings in said first and second end plates.

13. A wood particle screen as defined in claim 10, in which said first end of said bed is vertically adjustable relative to said end opposite said first end of said bed.

* * * * *

UNITED STATES PATENT AND TRADEMARK OFFICE

CERTIFICATE OF CORRECTION

PATENT NO. : 5,037,537

DATED : August 6, 1991

INVENTOR(S) : Joseph B. Bielagus

It is certified that error appears in the above-identified patent and that said Letters Patent is hereby corrected as shown below:

Column 8, line 3, "mans" should read --means--.

Signed and Sealed this

Twenty-ninth Day of December, 1992

*Attest:*

DOUGLAS B. COMER

*Attesting Officer*

*Acting Commissioner of Patents and Trademarks*